United States Patent [19]

Hatano et al.

[11] Patent Number: 5,020,788

[45] Date of Patent: Jun. 4, 1991

[54] PAPER FEEDING DEVICE

[75] Inventors: Masaru Hatano, Amagasaki; Tsukasa Sugiyama, Moriguchi, both of Japan

[73] Assignee: Mita Industrial Co., Ltd., Osaka, Japan

[21] Appl. No.: 439,839

[22] Filed: Nov. 21, 1989

[30] Foreign Application Priority Data

Nov. 25, 1988 [JP] Japan ..... 63-299217

[51] Int. Cl.[5] ..... B65H 1/14

[52] U.S. Cl. ..... 271/126; 271/3.1

[58] Field of Search ..... 271/3.1, 35, 126, 127, 271/131; 355/319

[56] References Cited

U.S. PATENT DOCUMENTS 4,155,546 5/1979 Jacobs ..... 271/3.1
4,544,147 10/1985 Dinnissen ..... 271/35

FOREIGN PATENT DOCUMENTS 123728 5/1988 Japan ..... 271/126
154545 6/1988 Japan ..... 271/35
197246 8/1989 Japan ..... 271/35

*Primary Examiner*—Joseph E. Valenza
*Assistant Examiner*—Steven Reiss
*Attorney, Agent, or Firm*—Antonelli, Terry, Stout & Kraus

[57] ABSTRACT

A paper feeding device for sending out paper sheets P from an intermediate tray after a first image has been formed on the paper sheets in an image forming apparatus. The device includes a preliminary feed roller, a pressure plate opposed to the preliminary feed roller, a feed roller, a pressure roller opposed to the feed roller, a roller supporting shaft for relatively rotatably supporting the pressure roller, a supporting member pivotably attached to the roller supporting shaft for supporting the pressure plate for pivotably around the roller supporting shaft, and a motor for rotating the roller supporting shaft. As a result the pressure plate and the pressure roller can pivot to maintain the paper sheets against the preliminary feed roller and the feed roller regardless of how many paper sheets are on the intermediate tray.

8 Claims, 4 Drawing Sheets

PAPER FEEDING DEVICE

BACKGROUND OF THE INVENTION

1. Field of the Invention

The present invention relates to proper feeding devices contained in image forming apparatuses such as an electrophotographic copying apparatus or a printer having a duplex image forming function and/or a composite image forming function.

2. Description of the Prior Art

Image forming apparatuses heretofore known include an image forming apparatus having an intermediate tray for of containing paper sheets on which an image has been formed and capable of sending out the paper sheets from the intermediate tray to form a second image on the paper sheets. Such as image forming apparatus contains a paper feeding device for sending out from the intermediate tray the paper sheets contained in the intermediate tray and feeding the same in the direction of an image forming section comprising a photosensitive drum, a developing device and the like. This paper feeding device is provided with, for example, (1) a preliminary feed roller provided in a lower part of the intermediate tray for sending out the paper sheets contained in the intermediate tray, (2) a pressure plate for pressing the paper sheets contained in the intermediate tray against the preliminary feed roller to assist in sending out the paper sheets from the intermediate tray by the preliminary feed roller, (3) a feed roller for conveying the paper sheets sent out from the preliminary feed roller in the direction of the image forming section, (4) a pressure roller for pressing the paper sheets sent out from the preliminary feed roller against the feed roller to assist in conveying the paper sheets by the feed roller.

The above described pressure plate can be detached from the feed roller so as not to prevent the paper sheets from being introduced into the intermediate tray. FIG. 4 is a schematic plan view showing a conventional mechanism for detaching a pressure plate from a feed roller. A pressure plate 102 is rotatably supported on a supporting shaft 101 fixed to a frame of an image forming apparatus. An end 102*a* of this pressure plate 102 is rotatably connected to one end 103*a* of a crank shaft 103 by means of a pin. The other end 103*b* of the crank shaft 103 is attached to a disk 109 rotated integrally with a secondary reduction gear 108. The secondary reduction gear 108 is rotated by a driving system 107 of the image forming apparatus through a primary reduction gear 106. The primary reduction gear 106 is connected to the driving system 107 through a spring clutch 105. This spring clutch 105 is intermittently operated by a lever 110 alternately turned to a position represented by a solid line and a position represented by a dot and dash line in FIG. 4. The lever 110 is connected to a rod 104*a* of a solenoid 104. The pressure plate 102 is rotated around the supporting shaft 101 to be detached from the feed roller or to be brought near the feed roller by exciting the solenoid 104 to bring the spring clutch 105 into a connected state.

However, in the above described paper feeding device, the driving force for detaching the pressure plate 102 from the feed roller is received from the driving system 107 of the image forming apparatus. Accordingly, it is difficult to construct the above pressure plate 102 and a mechanism for rotating the same as an exchangeable unit. Therefore, the paper feeding device has the disadvantage that maintenance thereof takes a lot of time and labor. In addition, the mechanism for rotating the pressure plate 102 is complicated. Accordingly, the paper feeding device also has the disadvantage that the manufacture thereof takes a lot of time and labor and the manufacturing cost thereof is high.

SUMMARY OF THE INVENTION

An object of the present invention is to provide a paper feeding device in which a pressure plate, a mechanism for driving the pressure plate and a pressure roller can be constructed as a unit whose maintenance is simply carried out.

Another object of the present invention is to provide a paper feeding device having a single structure and capable of being manufactured by simple processes and at low cost.

The above described objects can be achieved by providing a paper feeding device comprising an intermediate tray provided inside of an image forming apparatus for temporarily containing paper sheets on which an image has been formed by an image forming section, a preliminary feed roller for sending out from the intermediate tray the paper sheets contained in the intermediate tray, a pressure plate for pressing the paper sheets contained in the intermediate tray against the preliminary feed roller to assist in sending out the paper sheets from the intermediate tray by the preliminary feed roller, a feed roller for conveying the paper sheets sent out from the preliminary feed roller in the direction of the image forming section, a pressure roller for pressing the paper sheet sent out from the preliminary feed roller against the feed roller to assist in conveying the paper sheet by the feed roller, a roller supporting shaft for rotatably supporting the pressure roller, a supporting member pivotably attached to the roller supporting shaft for supporting the pressure plate for pivoting around the roller supporting shaft, and a motor for rotating the above roller supporting shaft in both forward and reverse directions.

In the above described paper feeding device, it is desirable that the roller supporting shaft be driven through a gear fit to the roller supporting shaft and that the roller supporting shaft and the gear be relatively rotatable over a predetermined angle such that the pressure plate can be turned according to the number of paper sheet contained in the intermediate tray.

Furthermore, in the above described paper feeding device, it is desirable that the pressure plate be pivotable around an axis parallel to the roller supporting shaft.

In the paper feeding device constructed as described above, the pressure plate can be turned in such a direction as to be detached from the preliminary feed roller by driving the driving motor in one direction to rotate the supporting member along with the roller supporting shaft. In addition, the pressure plate can be brought near the preliminary feed roller by driving the driving motor in the opposite direction to reverse the supporting member along with the roller supporting shaft.

When the above described roller supporting shaft is driven through the gear fit to the roller supporting shaft, and the roller supporting shaft and the gear are pivotable over a predetermined angle, the roller supporting shaft can be freely rotated over a predetermined angle with driving of the above gear being stopped. Consequently, the paper sheets contained in the intermediate tray can be pressed against the preliminary feed roller by bringing the pressure plate into contact with the paper sheets irrespective of the number of the paper sheets, with the pressure plate being turned to the side of the preliminary feed roller.

When the pressure plate is rotatably around an axis parallel to the roller supporting shaft, the pressure plate can be inclined while following the paper sheets contained in the intermediate tray. Consequently, the pressure plate can be always uniformly brought into contact with the paper sheets.

The foregoing and other advantages of the present invention will become more apparent from the following description when taken in conjunction with the accompanying drawings.

DESCRIPTION OF THE PREFERRED EMBODIMENTS

The present invention will be described in detail with reference to the accompanying drawings showing a preferred embodiment of the present invention.

Figure 3:
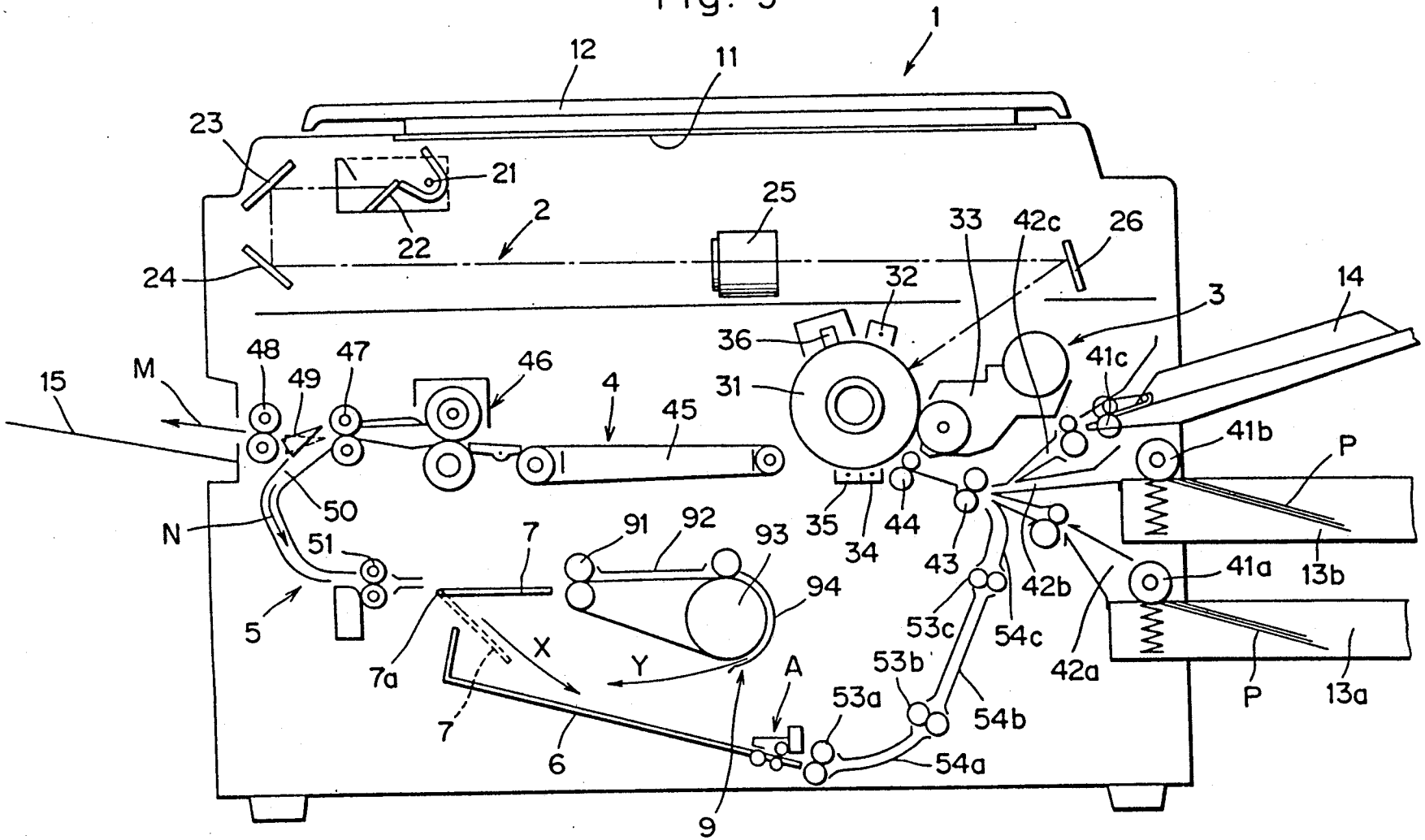
FIG. 3 is a schematic diagram illustrating an electrophotographic copying apparatus equipped with a paper feeding device according to the present invention.
Figure 4:
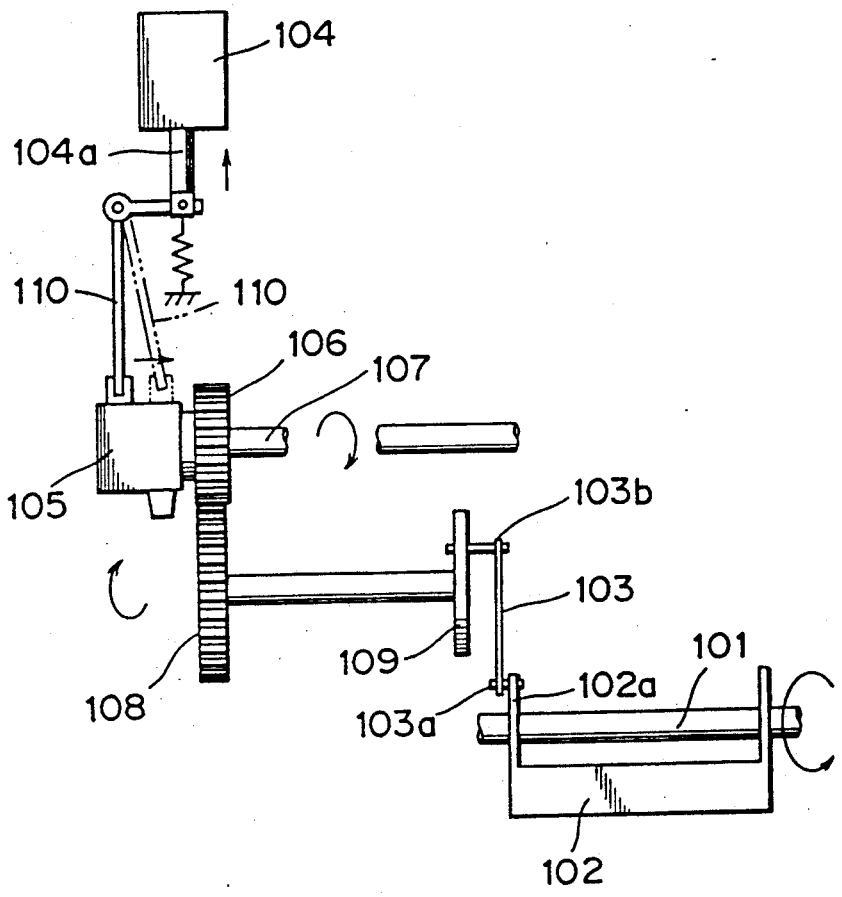
Fig. 4 (PRIOR ART)
FIG. 4 is a plan view showing a conventional paper feeding device.

FIG. 3 is a schematic diagram illustrating an electrophotographic copying apparatus equipped with a paper feeding device A according to the present invention. This electrophotographic copying apparatus comprises a transparent plate 11 and an original cover 12 in the upper part of the main body 1 of the electrophotographic copying apparatus and comprises an optical system 2, an image forming section 3, a first paper conveying section 4, a second paper conveying section 5 and an intermediate tray 6 inside of the main body 1 of the electrophotographic copying apparatus.

The optical system 2 is used for exposing a document (not shown), set on the above transparent plate 11, by a light source 21 and leading reflected light from the document to the image forming section 3 with mirrors 22, 23 and 24, a lens 25 and a mirror 26 as represented by a dot and dash line in FIG. 3.

The above described image forming section 3 is a section for forming a reproduced image on paper sheets P. This image forming section 3 comprises a corona discharger 32, a developing device 33, a transferring corona discharger 34, a separating corona discharger 35, and a cleaner 36 arranged in this order around a photosensitive drum 31. This image forming section 3 forms an electrostatic latent image corresponding to a document image on the surface of this photosensitive drum 31 by leading the reflected light from the document to the surface of the photosenitive drum 31 uniformly charged by the corona discharger 32. This electrostatic latent image is developed into a toner image by the developing device 33, the toner image is transferred onto the surfaces of the paper sheets P by the transferring corona discharger 34. The paper sheets P are stripped from the surface of the photosensitive drum 31 by the separating corona discharger 35 and then, any toner remaining on the surface of the photosensitive drum 31 is recovered by the cleaner The first paper conveying section 4 comprises paper feeding cassettes 13*a* and 13*b* mounted on a side portion of the main body 1 of the electrophotographic copying apparatus such that they can be pulled out, feed rollers 41*a*, 41*b* and 41*c* for sending out the paper sheets P one at a time from cassette 13*a*, from cassette 13*b*, or from a stacking bypath 14, respectively paper feeding paths 42*a*, 42*b* and 42*c* for guiding the paper sheets P sent out, a registration roller 43 and a delivery roller 44 for feeding to the image forming section 3 the paper sheets P conveyed through the paper feeding paths with predetermined timing, a delivery belt 45 for conveying the paper sheets P on which a reproduced image was formed by the image forming section 3, a heating and fixing device 46 for fixing the reproduced image on the paper sheet P, a delivery roller 47 for conveying the paper sheets P passed through the heating and fixing device 46, and a discharge roller 48 for discharging the paper sheets P from the main body 1 of the electrophotographic copying apparatus. In addition, the second paper conveying section 5 is branched from a portion of a switching craw 49 provided between the delivery roller 47 and the discharge roller 48. An intermediate tray 6 is interposed in a halfway portion of the second paper conveying section 5. In addition, an end on the downstream side of the second paper conveying section 5 is connected to the registration roller 43.

When a document is copied on the paper sheets P only once, the paper sheets on which the image has been formed are discharged onto a tray 15 as represented by arrow M in FIG. 3 by causing the only first paper conveying section 4 to convey the paper sheets. In addition, when a document is copied on one side or on both sides of the paper sheets P two or more times, the paper sheets on which the image was formed once are sent to the second paper conveying section 5 as represented by an arrow N in FIG. 3 by switching the switching claw 49 and are contained in the intermediate tray 6 once and then, are fed to the image forming section 3, causing the image forming section 3 to form another image.

The section paper conveying section 5 comprises a guide path 50, a delivery roller 51 and a branching guide plate 7 for feeding the intermediate tray 6 for holding the paper sheets P on which the first image was formed, delivery rollers 53*a*, 53*b* and 53*c* and the paper feeding paths 54*a* , 54*b* and 54*c* for feeding to the registration roller 43 the paper sheets P sent out from the paper feeding device A provided in the vicinity of an end on the downstream side of the intermediate tray 6.

The branching guide plate 7 is pivotably supported by a supporting shaft 7*a* and is turned to positions represented by a solid line and a chain line in FIG. 3 by driving means (not shown). When the branching guide plate 7 is turned to the position represented by the chain line, the paper sheets P are directly fed to the intermediate tray 6 as represented by an arrow X in FIG. 3. The surfaces on which an image has been formed on the paper sheets P fed to the intermediate tray 6 are the lower surfaces. Accordingly, if these paper sheets P are sent out from the intermediate tray 6 and fed to the image forming section 3, the second image is formed on the same side as the surfaces on which the first image was reproduced, providing a composite copy. In contrast, when the branching guide plate 7, is turned to the position represented by the solid line, the paper sheets P are fed to the intermediate tray 6 by way of a reverse section 9 comprising a delivery roller 91, guide paths 92 and 94 and a reverse roller 93. The surfaces on which the first image was formed one the paper sheets P fed to the intermediate tray 6 are then the upper surfaces. Accordingly, if these paper sheets P are sent out from the intermediate tray 6 and fed to the image forming section 3, the second image is formed on the opposite side from the surfaces on which the first image was reproduced, providing a duplex copy.

Figure 1:
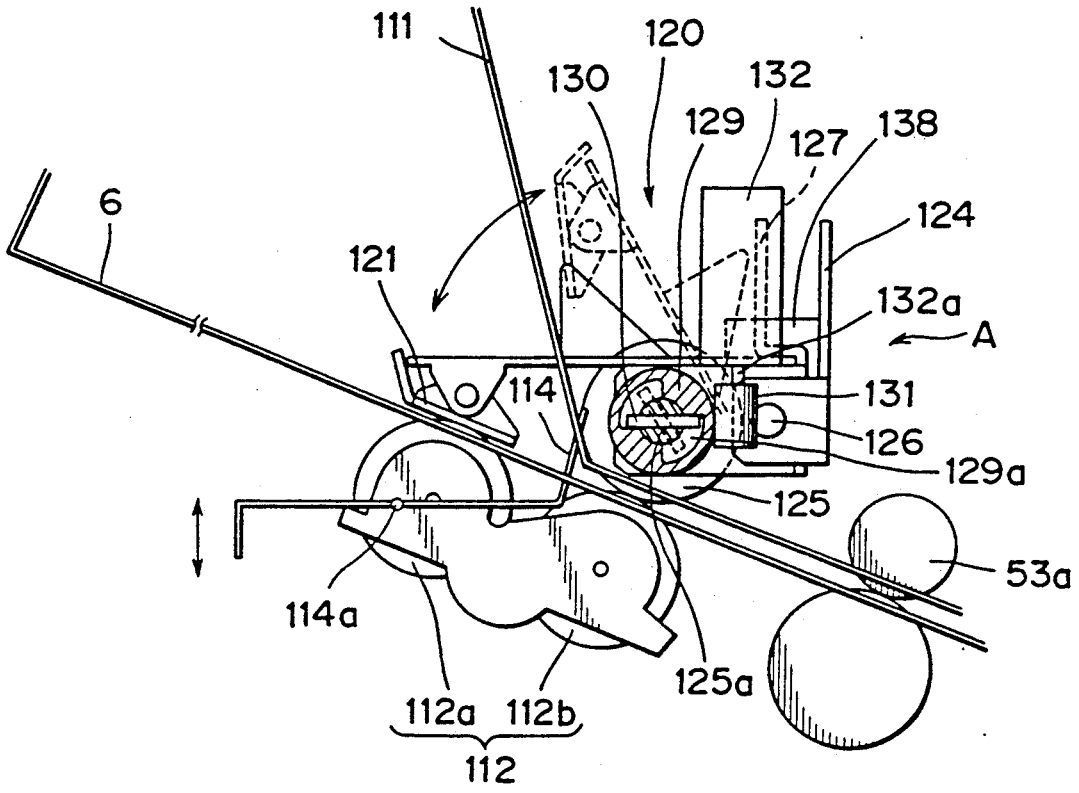
FIG. 1 is a front view showing an embodiment of a paper feeding device according to the present invention.
Figure 2:
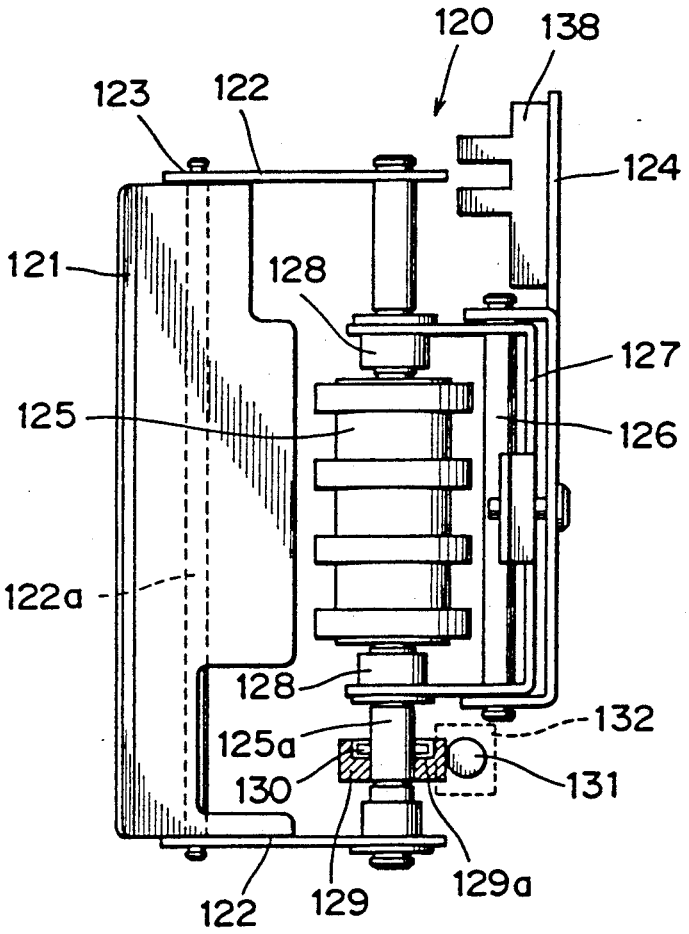
FIG. 2 is a plan view of the embodiment of FIG. 1.

With reference to FIGS. 1 and 2, the paper feeding device A comprises a plurality of feed rollers 112 provided below the intermediate tray 6 and pressing means 120 provided above the intermediate tray 6. A part of the periphery of each of the feed rollers 112 projects above the upper surface of the intermediate tray 6 through an opening (not shown) formed in the intermediate tray 6. The paper feeding device A presses one or a plurality of sheets P of paper contained in the intermediate tray 6 against the feed roller 112 by the pressing means 120 and sends out the sheets to the downstream side one at a time. The intermediate tray 6 is provided with a stopper 114 for aligning ends of the paper sheets P introduced into the intermediate tray 6. This stopper 114 is pivotable around a fulcrum 114*a* for sending out the paper sheets P from the intermediate tray 6. In addition, a guide plate 111 for aligning the ends of the paper sheets P located above a predetermined position on the side of an upper end of the stopper 114 is provided above the intermediate tray 6 and intersects stopper 114.

The feed rollers 112 comprise a preliminary feed roller 112*a* and a feed roller 112*b* respectively rotating around axes perpendicular to the direction of sending out the paper sheets P. The feed roller 112*b* is provided on the downstream side of the preliminary feed roller 112*a*. The rollers 112*a* and 112*b* are rotatably driven at predetermined timing by a driving system in the electrophotographic copying apparatus.

The pressing means 120 comprises a pressure plate 121, for pressing the paper sheets P contained in the intermediate tray 6 against the preliminary feed roller 112*a*, to assist in sending out of the paper sheet P by the preliminary feed roller 112*a*, and a pressure roller 125, for pressing the paper sheets P sent out by the preliminary feed roller 112*a* against the feed roller 112*b* to assist in conveying of the paper sheets P by the feed roller 112*b*.

The pressure plate 121 is supported on a roller supporting shaft 125*a* for relatively rotatably supporting the pressure roller 125 through a pair of arms 122 serving as a supporting member, as shown in FIG. 2. The arms 122 have their base ends respectively fixed to both ends of the roller supporting shaft 125*a*. The pressure plate 121 is turned by the rotation of the roller supporting shaft 125*a*. The pressure plate 121 is attached to a shaft 122*a* parallel with the roller supporting shaft 125*a* and held between top ends of the arms 122. The pressure plate 121 can be pivoted around the shaft 122*a*. Consequently, the pressure plate 121 satisfactorily follows the paper sheet P when the plate abuts on the paper sheet P. Accordingly, the pressure plate 121 is always brought into surface contact with the paper sheet P.

The roller supporting shaft 125*a* is rotatably held by a blanket 127 through bearings 128 provided on both ends of the pressure roller 125. The blanket 127 is supported on a fixing plate 124 attached in a predetermined position inside of the electrophotographic copying apparatus so as to be pivotable around a supporting shaft 126. Consequently, the pressure plate 121 and the pressure roller 125 can abut on the preliminary feed roller 112*a* and the feed roller 112*a*, respectively and are pivotable around the supporting shaft 126 to a position detached from rollers 112*a* and 112*b*.

A spring pin 130 passes through the roller supporting shaft 125*a* on its one end. Both ends of this spring pin 130 project from the peripheral surface of the roller supporting shaft 125*a*. In addition, a helical gear 129 for transmitting the turning force to the roller supporting shaft 125*a* is relatively rotatably fit to a portion, through which the above spring pin 130 is penetrated, of the roller supporting shaft 125*a*. A worm gear 131 is engaged with this helical gear 129. This worm gear 131 is rotatably driven by a driving motor 132 supported on the fixing plate 124.

The helical gear 129 is provided with a fan-shaped engaging groove 129*a* for engaging the spring pin 130 with play. This engaging groove 129*a* is formed such that the roller supporting shaft 125*a* and the helical gear 129 can be relatively idled by approximately one-sixth rotation. The roller supporting shaft 125*a* and the helical gear 129 can be thus relatively rotated in a constant range so as to allow the pressure plate 121 to be freely moved to a position corresponding to the number of paper sheets P contained in the intermediate tray 6, with the arms 122 being turned downward by driving of the driving motor 132 and so as to prevent overload from being applied to the driving motor 132, the arms 122 and the like by the shift in position where the rotation of the helical gear 129 is stopped to cause the pressure plate 121 not to come into contact with the preliminary feed roller 112*a* and to cause the pressure plate 121 to be turned more than necessary.

The fixing plate 124 is provided with an optical sensor 138 for sensing that the arms 122 have risen to a predetermined position. When the optical sensor 138 senses the rise of the arms 122 while the pressure plate 121 is turned upward, driving of the driving motor 132 is stopped in response to a signal from this optical sensor 138. In addition, when the pressure plate 121 is turned downward, the driving motor 132 is driven by a timer for only a constant time period.

In the paper feeding device A constructed as described above, the helical gear 129 can be rotated around the roller supporting shaft 125*a* by driving the driving motor 132 in one direction to transmit the driving force of the driving moter 132 to the helical gear 129 from the worm gear 131. In this situation, the helical gear 129 is engaged with the spring pin 130 after slight idling. The roller supporting shaft 125*a* is rotated as gear 129 and pin 130 are engaged with each other, so that the pressure plate 121 is turned upward through the arms 122. Accordingly, the paper sheets P can be introduced into the intermediate tray 6. Furthermore, the paper sheets P can be pressed against the preliminary feed roller 112*a* by reversing the driving motor 132 at the time when the paper sheets P are contained in the intermediate tray 6 to lower the pressure plate 121 onto the above paper sheets P.

Alternatively, as a mechanism for transmitting the driving force of the driving motor 132 to the roller supporting shaft 125*a*, the helical gear 129 and the worm gear 131 can be replaced with bevel gears. In addition, if the driving motor 132 is arranged such that the axis 132*a* of rotation thereof is parallel to an axis of the roller supporting shaft 125*a*, a spur gear can be employed. Besides, the driving force of the driving motor 132 may be transmitted by a timing belt and a chain. Furthermore, a geared motor may be directly connected to the roller supporting shaft 125*a* through a coupling.

As described in the foregoing, the paper feeding device according to the present invention has a dedicated motor for turning the pressure plate. Furthermore, in the paper feeding device, the pressure plate, together with the pressure roller, is supported on the roller supporting shaft through the supporting member, so that they can be integrally constructed as a unit. Consequently, maintenance of the paper feeding device can be substantially simply carried out. In addition, the structure thereof is simple. Consequently, the paper feeding device is manufactured by simple processes and the manufacturing cost thereof can be lowered.

What is claimed is:

1. A paper feeding device comprising:

an intermediate tray adapted to be provided inside of an image forming apparatus for temporarily containing paper sheets after a first image has been formed thereon by an image forming section of the image forming apparatus;

a preliminary feed roller for sending out from said intermediate tray the paper sheets contained in said intermediate tray;

a pressure plate for pressing the paper sheets contained in said intermediate tray against said preliminary feed roller to assist said preliminary feed roller in sending out the paper sheets from said intermediate tray;

a feed roller for conveying the paper sheets sent out by said preliminary feed roller in the direction of the image forming section;

a pressure roller for pressing the paper sheets sent out by said preliminary feed roller against said feed roller to assist said feed roller in conveying the paper sheets;

a roller supporting shaft for rotatably supporting said pressure roller;

a supporting member pivotably attached to said roller supporting shaft and supporting said pressure plate for pivoting of the pressure plate around said roller supporting shaft in response to rotation of said roller supporting shaft;

a gear connected to said roller supporting shaft to drive said roller supporting shaft, said roller supporting shaft and said gear being relatively rotatable over a predetermined angle such that said pressure plate can be pivoted to a position according to the number of paper sheets contained in said intermediate tray; and a motor for rotating said gear to rotate said roller supporting shaft.

2. The paper feeding device according to claim 1, wherein said roller supporting shaft has an engaging section projecting in the direction of the shaft diameter, and said gear has an engaging groove adapted to be engaged with said engaging section at a time point when said gear has rotated over a constant angle.

3. The paper feeding device according to claim 2, wherein said engaging section of said roller supporting shaft comprises a pin engaging said roller supporting shaft.

4. The paper feeding device according to claim 1, wherein said pressure plate is rotatable around an axis parallel to said roller supporting shaft.

5. A paper feeding device for feeding paper sheets from an intermediate tray provided inside of an image forming apparatus, the intermediate tray temporarily containing the paper sheets after a first image has been formed thereon by an image forming section of the image forming apparatus, said paper feeding device comprising:

a preliminary feed roller for sending out from the intermediate tray the paper sheets contained in the intermediate tray;

a pressure plate for pressing the paper sheets contained in the intermediate tray against said preliminary feed roller to assist said preliminary feed roller in sending out the paper sheets from the intermediate tray;

a feed roller for conveying the paper sheets sent out by said preliminary feed rolller in the direction of the image forming section;

a pressure roller for pressing the paper sheets sent out by said preliminary feed roller against said feed rooler to assist said feed roller in conveying the paper sheets;

a roller supporting shaft for rotatably supporting said pressure roller;

a supporting member pivotably attached to said roller supporting shaft and supporting said pressure plate for pivoting of the pressure plate around said roller supporting shaft in response to rotation of said roller supporting shaft;

a gear connected to said roller supporting shaft to drive said roller supporting shaft, said roller supporting shaft and said gear being relatively rotatable over a predetermined angle such that said pressure plate can be pivoted to a position according to the number of paper sheets contained in said intermediate tray; and a motor for rotating said gear to rotate said roller supporting shaft.

6. The paper feeding device according to claim 5, wherein said roller supporting shaft has an engaging section projecting in the direction of the shaft diameter, and said gear has an engaging groove adapted to be engaged with said engaging section at a time point when said gear has rotated over a constant angle.

7. The feeding device according to claim 6, wherein said engaging section of said roller supporting shaft comprises a pin engaging said roller supporting shaft.

8. The paper feeding device according to claim 5, wherein said pressure plate is rotatably around an axis parallel to said roller supporting shaft. 191

* * * * *